US007168263B1

(12) United States Patent
Zenner

(10) Patent No.: US 7,168,263 B1
(45) Date of Patent: Jan. 30, 2007

(54) PORTABLE BEVERAGE COOLER AND DISPENSER

(76) Inventor: Eugene R. Zenner, 296 Laurel La., Fond du lac, WI (US) 54935

( * ) Notice: Subject to any disclaimer, the term of this patent is extended or adjusted under 35 U.S.C. 154(b) by 0 days.

(21) Appl. No.: 11/279,135

(22) Filed: Apr. 10, 2006

(51) Int. Cl.
*F25D 3/08* (2006.01)

(52) U.S. Cl. ..... 62/457.1

(58) Field of Classification Search ..... 62/371, 62/457.1, 457.5
See application file for complete search history.

(56) References Cited

U.S. PATENT DOCUMENTS

| | | | | |
|---|---|---|---|---|
| 3,717,282 | A | 2/1973 | Nordskog | |
| 4,516,409 | A | 5/1985 | Hobbs | |
| 4,655,052 | A | 4/1987 | Garcia | |
| D291,524 | S | 8/1987 | Yanniell | |
| 4,852,767 | A * | 8/1989 | Humphrey | 221/241 |
| 4,910,977 | A | 3/1990 | Hilton | |
| 4,924,682 | A | 5/1990 | Penner | |
| D370,158 | S | 5/1996 | Martin | |
| 6,782,711 | B2 | 8/2004 | Abfalter | |
| 6,799,434 | B1 | 10/2004 | Hobbs, Jr. | |
| D501,343 | S | 2/2005 | Miesieski | |
| D501,344 | S | 2/2005 | Miesieski | |
| 6,964,179 | B2 | 11/2005 | Yoshida | |

* cited by examiner

*Primary Examiner*—Melvin Jones
(74) *Attorney, Agent, or Firm*—John K. McCormick

(57) ABSTRACT

A stable portable beverage dispensing cooler includes a spring loaded dispensing unit for beverages with freezer packs between the rows of beverages for maintaining the beverages in a chilled environment. The portable cooler includes a lower drawer for storage and at least two snack trays and two beverage trays. The cooler lid can be formed in the shape of any outdoor activity, such as soccer, football or the like, to show support for the outdoor activity. The base of the cooler is wider and longer than the cooler body to provide greater stability to the portable cooler.

34 Claims, 13 Drawing Sheets

PORTABLE BEVERAGE COOLER AND DISPENSER

BACKGROUND OF THE INVENTION

The present invention relates to a stable portable beverage cooler and beverage dispenser which enables beverages to be readily carried, maintained in a cool condition and easily dispensed from the container while any remaining beverages are maintained cool. Additional embodiments of the invention include fold out beverage holders, fold out shelves for snacks or the like and a storage section for containing food and/or garbage.

Individuals or groups of people traveling to and from various locations, such as soccer games, football games, picnics, fishing or the like, may find it desirable or even necessary to maintain a variety of food items and/or cooled beverages while in transit. While engaged in an outdoor activity, an individual will often need to have cold beverages and food stuffs readily available for consumption. In addition, when an individual or group chooses to end their outdoor activity there is a need to take with them for disposal any and all empty food and beverage wrappers and/or containers.

A variety of portable containers have been provided for the transportation, storage and removal of beverages in a minimum of dimension, for example in a golf bag. Examples of this type of container are shown in U.S. Pat. No. 4,910,977 to Hilton, U.S. Pat. No. 4,516,409 to Hobbs and U.S. Pat. No. 3,717,282 to Nordskog. These patents generally relate to tubular shaped containers which include springs to force the cans upward for dispensing and can be placed inside of a golf bag, strapped to the outside of a golf bag or carried by the user. The Hobbs patent discloses a cylindrical tube that opens at both ends to allow for beverages to be dispensed at one end and to provide storage for empty cans at the other end. Devices such as these provide dispensed cooled beverages but tend to be sport specific and due to their structure will tip over if placed upright on the ground.

Other types of portable coolers are well known in the art such as in U.S. Pat. No. 4,655,052 to Garcia, U.S. Pat. No. 6,782,711 to Abfalter, U.S. Pat. No. 6,799,434 to Hobbs, Jr. and Design Pat. No. 296,066 to Tarozzi et al. The Garcia patent discloses a portable cooler including a main cavity for storing food stuff and a coolant and an auxiliary cavity which stores beverages which can be cooled while being consumed. Abfalter discloses a portable cooler with separate water tight food storage compartment and an ice storage area immediately above the food storage compartment where ice is maintained separate from the food. Hobbs, Jr. discloses a battery powered insulated portable cooler for transporting beverages and/or food. Each of these patents provide a stable means for transporting and making available chilled food and beverages for consumption.

While these devices may be suitable for the particular purpose employed, or for general use, they would not be as suitable for the purposes of the present invention as disclosed hereinafter.

SUMMARY OF THE INVENTION

It is an object of the invention to provide a portable cooler which may be easily transported between locations and that provides for the individual dispensing of cooled beverages and that is stable when placed upon a surface such as the ground or a table.

It is a further object of this invention to provide a portable cooler that provides collapsible means for holding food stuffs and snacks while they are being consumed.

It is yet a further object of this invention to provide a cooler with a means for storing and transporting food stuffs to a location and garbage away from the location.

It is an additional object of this invention to provide a portable cooler which can be decorated or embellished with a specific outdoor activity to show support for the outdoor activity such as for soccer, football, fishing or a specific team logo or the like.

Further objects of the invention will become apparent in the detailed description of the invention which follows.

The invention is a portable beverage dispensing cooler which has a wider base than the top to prevent the cooler from tipping over when in use. The portable cooler includes both beverage holders and food trays that fold down from the side of the cooler when in use. When not in use or during transportation, the trays can be folded back up to be out of the way. The portable cooler includes in its base a door that opens up and closes for storing food stuffs or other items when in transit to a location and can be used to hold returning items such as garbage or other items when exiting the location. The top of the dispensing cooler can be made to resemble some specific outdoor activity such as a soccer ball, a team helmet or hat, a racing car or the like to show support for the specific outdoor activity.

To the accomplishment of the above and related objects the invention may be embodied in the form illustrated in the accompanying drawings. Attention is called to the fact that the drawings are illustrative only. Variations are contemplated as being part of the invention as defined by the claims.

DETAILED DESCRIPTION OF THE PREFERRED EMBODIMENTS

Figure 1:
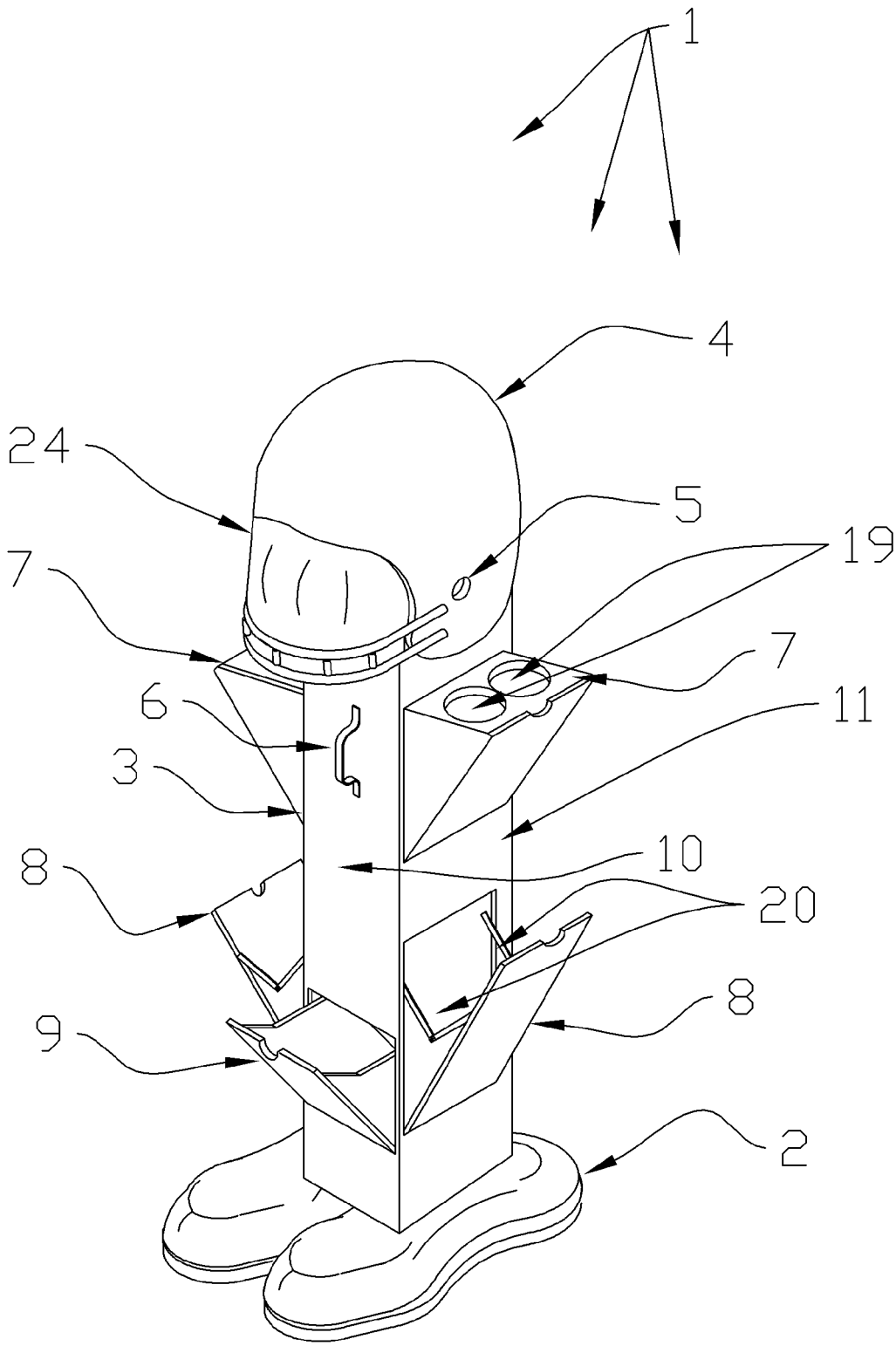
FIG. 1 is a perspective view illustrating the portable cooler of the present invention with the trays and doors in the open position and the lid in a closed position.

Reference will now be made in detail to the description of the invention as illustrated in the drawings. Although the invention is described in connection with the drawings, there is no intent to limit the invention to the embodiment or embodiments disclosed therein. On the contrary, the intent is to include all alternatives, modifications, and equivalents included within the scope and spirit of the invention as defined by the appended claims. The invention and its alternatives, modifications, derivatives and/or equivalents in other applications are meant to be included within the scope and spirit of the invention as defined by the appended claims.

Referring now to the drawings, FIG. 1 is a perspective view of a first embodiment of the portable cooler 1. The portable cooler 1 consists of a base 2 larger than the cooler body 3 to aid in stability as will be discussed later. The cooler body 3 consists of a frontal wall 10, two side walls 11 and 12 (only one is shown in this view) and a rear wall 13 (not shown in this view). In this embodiment the cooler lid 4 is depicted in the form of a football helmet with a transparent face shield 24, although other shaped lids 4, for example soccer balls or baseball caps, could be utilized. A latch (not shown) secures the lid 4 to the cooler body 3 when the portable cooler 1 is not is use or during transportation of the portable cooler 1. The cooler lid 4 is hinged 5 to the cooler body 3 on the two side walls 11 and 12 (only one side is shown). There is a carrying handle 6 located on the upper half of the frontal wall 10 such that the portable cooler 1 is balanced when it is loaded with beverages and snacks and is being carried. The handle 6 could be located on the rear wall 13 if desired. In the alternative, a shoulder strap (not shown) could be utilized in addition to the handle 6 or in place of the handle 6. Near the top of the portable cooler 1 are two fold down beverage holders comprised of a door cover 7 and two beverage holders 19, one door cover 7 with beverage holders 19 on each side wall 11 and 12. The beverage holders 19 and door cover 7 may be folded up when not in use and a latch (not shown) on the door cover 7 secures the beverage holder 19 and door cover 7 to the side walls 11 or 12 when the portable cooler 1 is not in use or during transportation. On the lower half of the cooler body 3 are two snack trays 8, one on either side wall 11 and 12. Each snack tray 8 is supported by two hinge arms 20 such that the snack tray 8 may be folded down when in use or folded up when not in use. A latch (not shown) on the snack tray 8 secures the snack tray 8 to the side wall 11 or 12 when not in use or for transportation. Also at the lower half of the cooler body 3 is a drawer 9 which opens up for carrying objects such as food, snacks or other objects to an event. The drawer 9 can also be utilized for storing and transporting garbage when departing from an event.

Additional snack trays 8 and/or beverage holders 19 and doors 7 could be added to the sides, front or back of the portable cooler 1 without departing from the scope of this invention. In addition, the portable cooler 1 could be made to hold more than two columns of beverages 14 or the beverage columns could be made shorter or taller to hold fewer or greater number of beverages 14 without departing from the scope of this invention.

Figure 2:
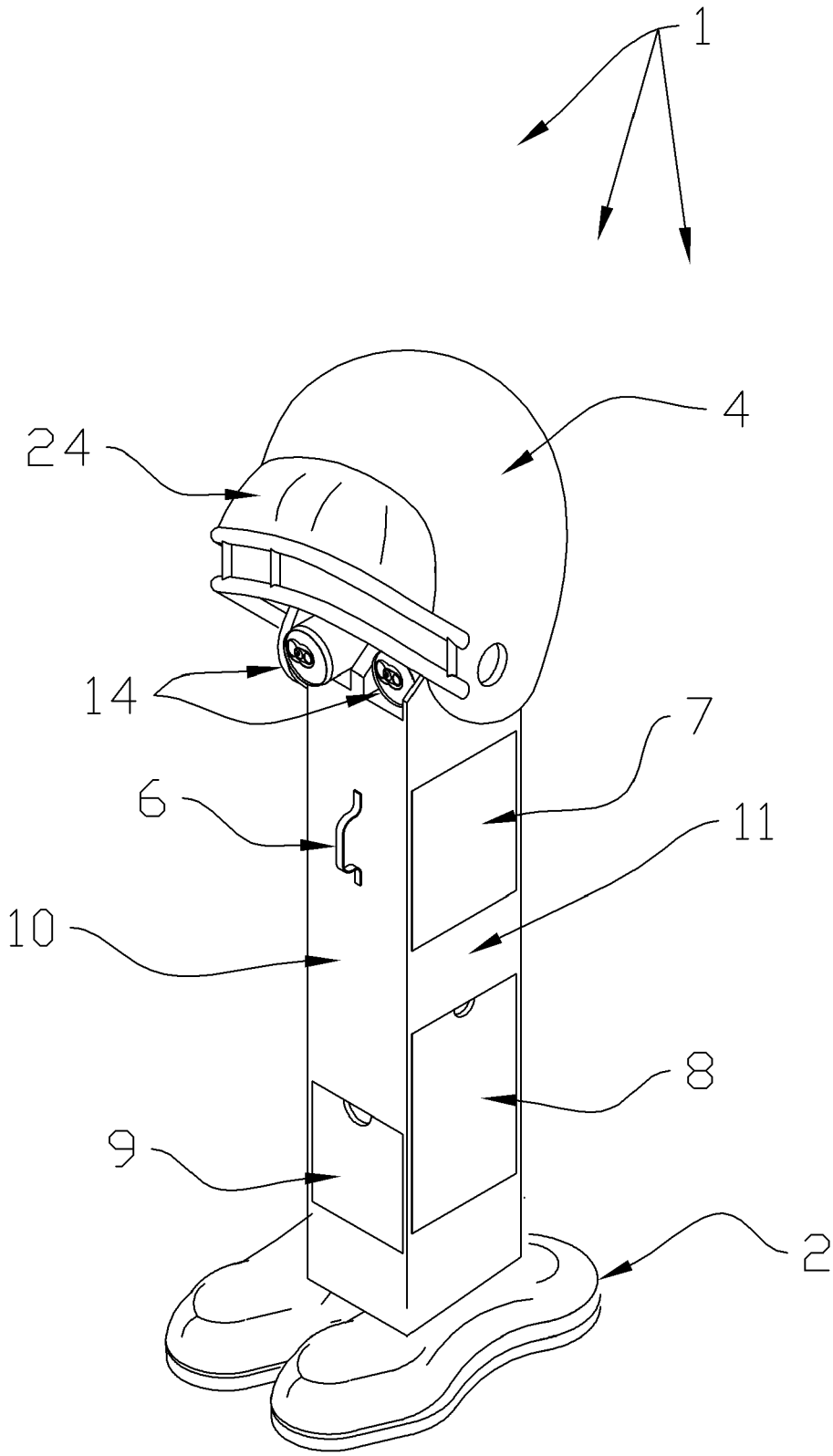
FIG. 2 is a perspective view of the portable cooler of FIG. 1 with the trays and door in the closed position and the lid in the open position.

FIG. 2 is a perspective view of the portable cooler 1 with the lid 4 in an opened position and the door 7, tray 8 and drawer 9 in the closed position. Shown positioned inside of the portable cooler 1, at the top of the cooler 1 ready for dispensing, are two beverages 14.

Figure 3:
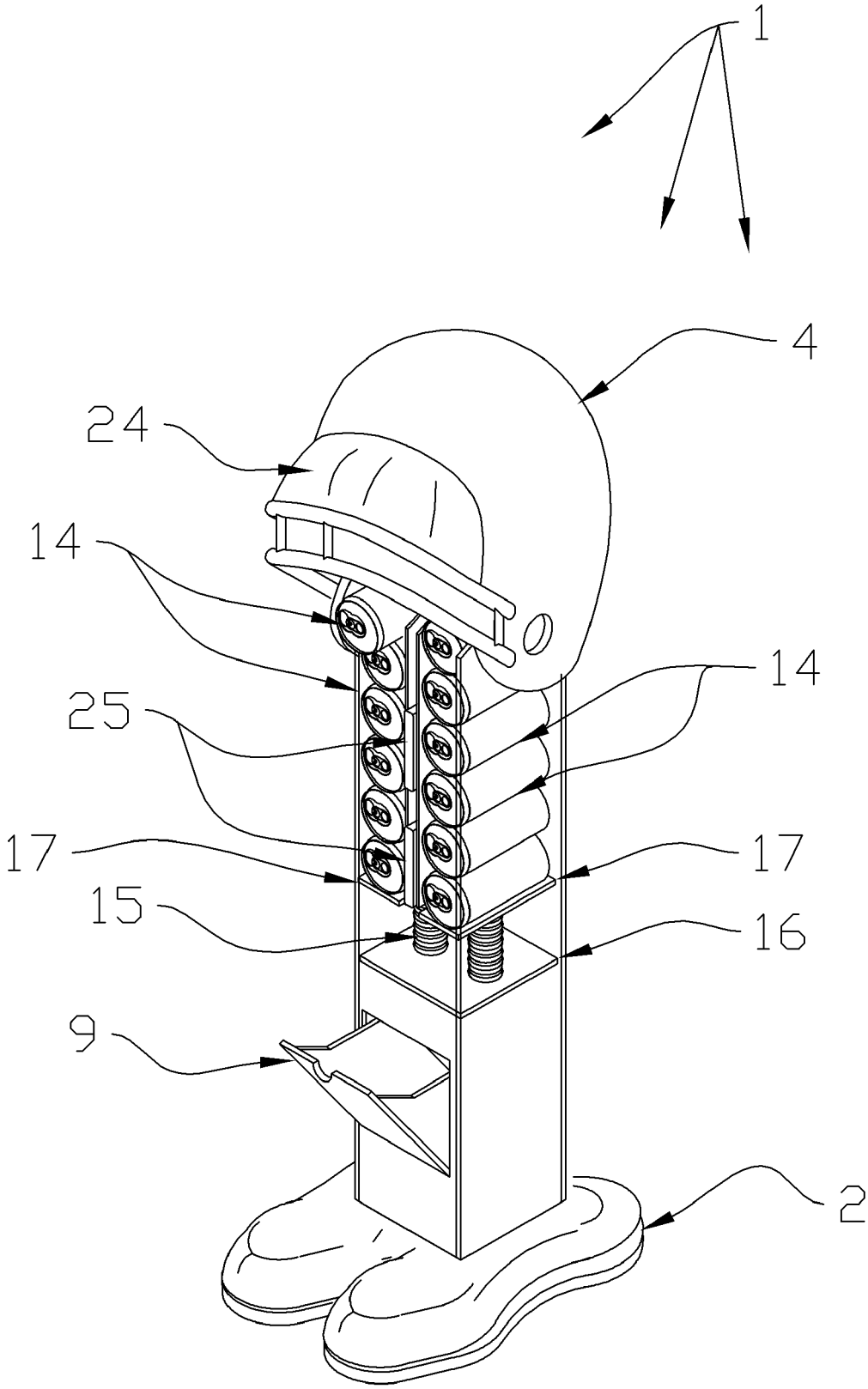
FIG. 3 is a cut away perspective view of FIG. 1 showing the inside of the portable cooler with beverage cans in the dispensing unit.

FIG. 3 depicts a cut away view of the inside of the portable cooler 1. The beverages 14 rest on movable plates 17. Each movable plate 17 rides on the top of a spring 15. The bottom of the spring 15 rests on a fixed surface 16 that separates the drawer 9 from the movable plate 17 and the beverages 14. As beverages 14 are removed, the spring 15 pushes up the movable plate 17 along with the beverages 14 so that the next available beverage 14 is at the top of the portable cooler 1. Between the two rows of beverages 14 is a space into which freezer packs 25, of the type commonly known, can be placed in order to keep the beverages 14 cool.

Figure 4:
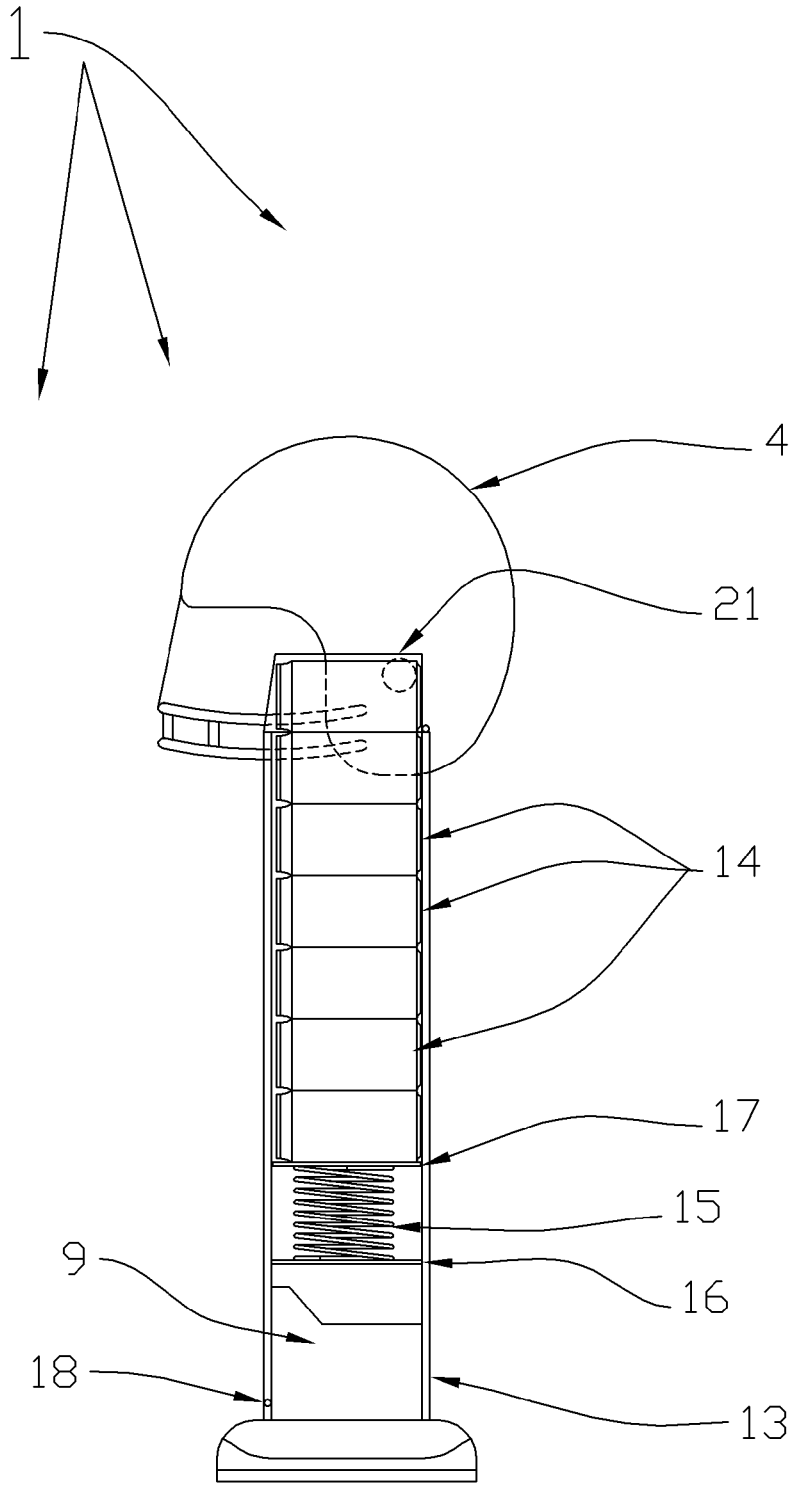
FIG. 4 is a cut away side view of the portable cooler of FIG. 1 with the lid in the closed position.

FIG. 4 depicts a side cut away view of the portable cooler 1. The beverages 14 are supported by the movable plate 17 which rests on a coil spring 15 which is attached to the fixed surface 16. The drawer 9 is hinged 18 such that the drawer 9 can be pivoted open or closed. A latch (not shown) would hold the drawer 9 in a closed position when the cooler 1 is not in use or during transportation.

Figure 5:
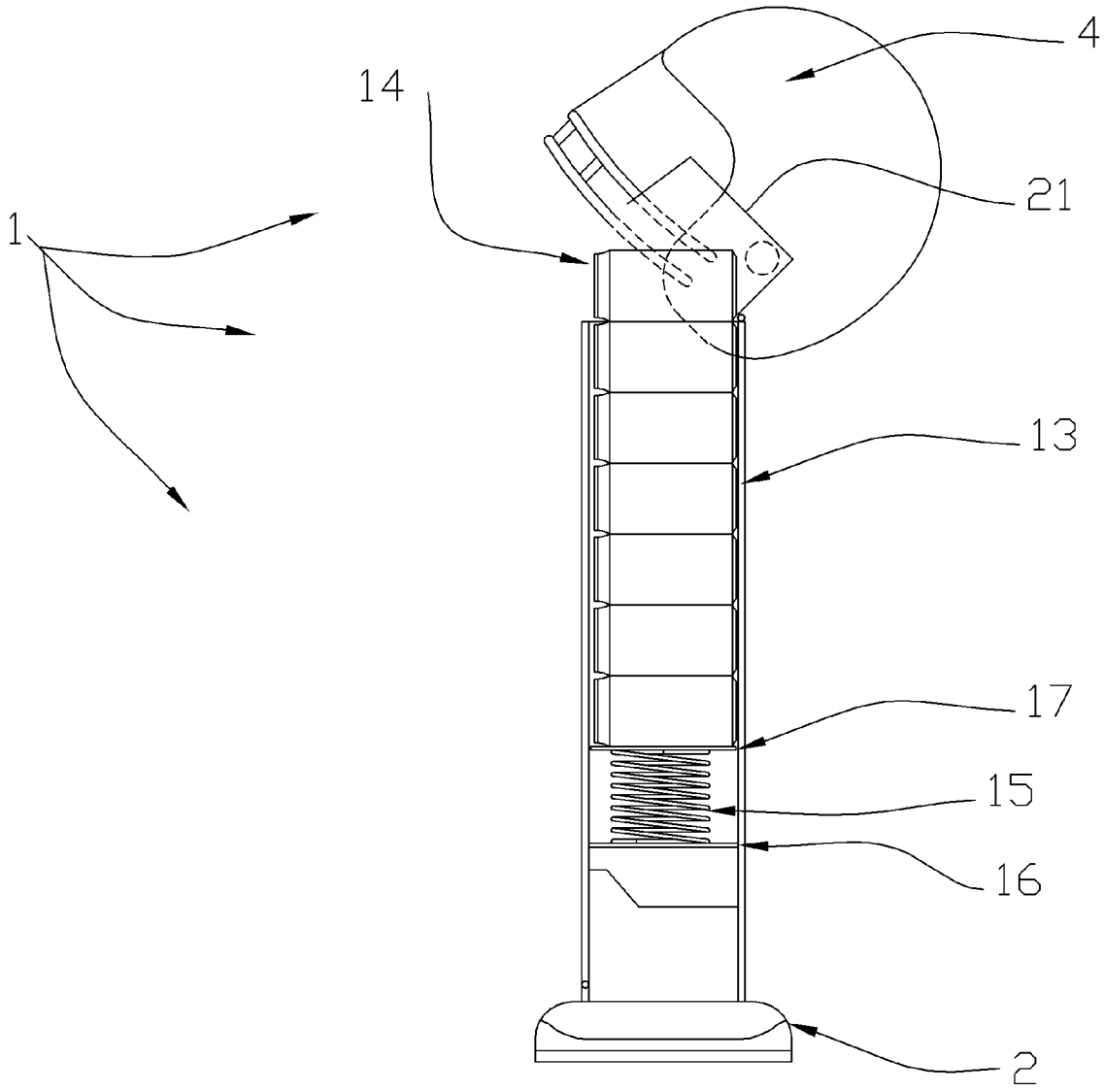
FIG. 5 is a cut away side view of the portable cooler of FIG. 1 with the lid in the open position.

FIG. 5 depicts the a cut away view of the portable cooler 1 with the lid 4 open and a beverage 14 ready for removal from the top of the portable cooler 1. As can be seen in FIG. 5, the inside of the lid 4 has a cutout 21 that is slightly larger than the beverage 14 so that when the lid 4 is in the closed position the lid 4 seals in the beverages 14 and traps the cold air inside with the beverages 14. The cutout 21 also provides a means for keeping the top beverages 14 in a confined space during transportation so as not to unduly disturb the contents of the beverage 14.

Figure 6:
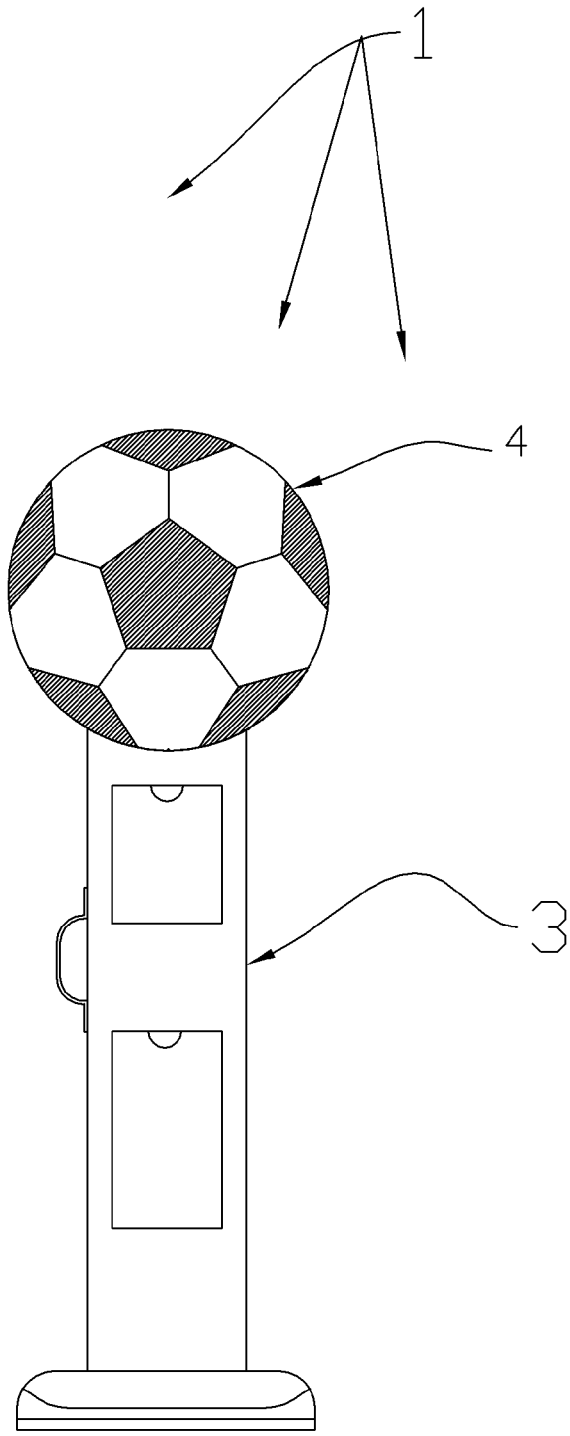
FIG. 6 depicts the lid as representing a soccer ball.
Figure 7:
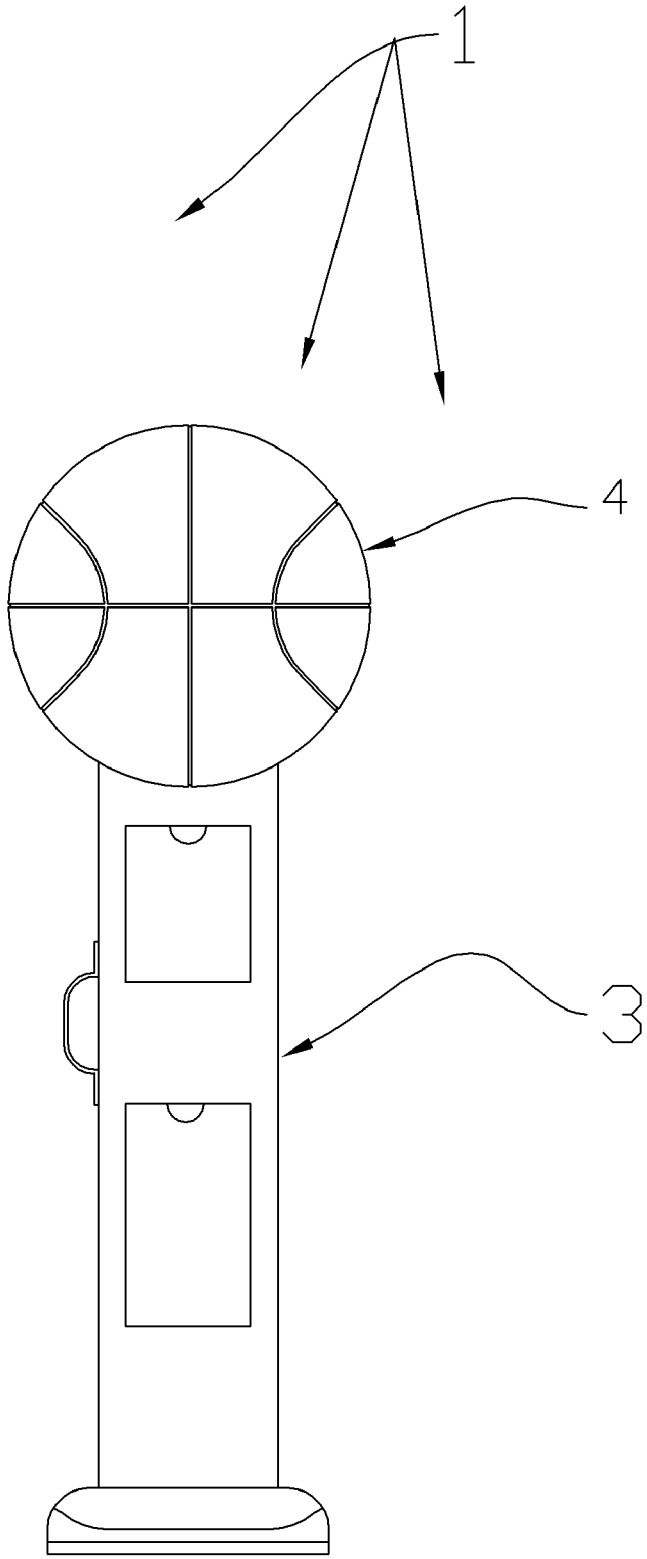
FIG. 7 depicts the lid as a representing a basketball.

FIG. 6 depicts the portable cooler 1 with the lid 4 shaped as a soccer ball. FIG. 7 depicts the portable cooler 1 with a basketball shape for the lid 4. Other shapes for the lid 4 are readily apparent, for example only, shapes such as baseball caps, race cars, fish or other shapes could be utilized.

Figure 8:
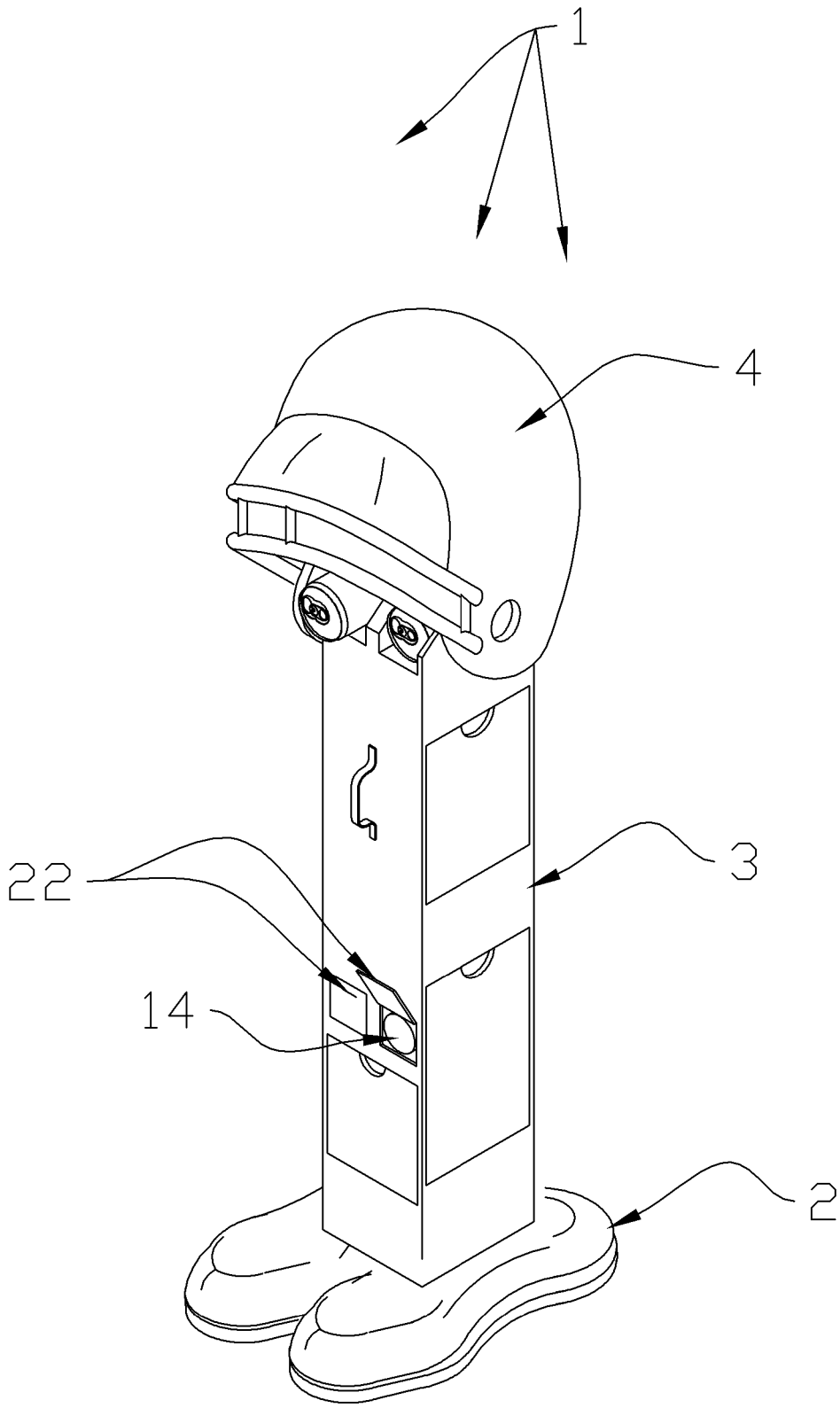
FIG. 8 is a side cut away view of an alternate embodiment of the beverage dispensing unit.

FIG. 8 depicts a second embodiment of the portable cooler 1 with two beverage drawers 22 slightly larger than the diameter of the beverages 14. In this embodiment, there is no internal spring or movable plate. Rather, the beverages 14 are loaded from the top when the lid 4 is opened. The beverages 14 are gravity fed to the beverage drawers 22. When a user desires to access a beverage 14, they open one of the drawers 22 and remove a beverage 14.

As the portable beverage cooler 1 utilizes a row stacking arrangement for the beverages 14 and has a drawer opening 9 in the bottom portion of the cooler body 3 for storage and/or trash, the portable cooler 1 of this invention tends to be "top heavy" when in use. As such, the base 2 of the portable cooler 1 as shown in FIGS. 1, 2, 3, 4, 5, 6, 7 and 8 is larger in both length and width than the cooler body 3 to provide a steadier support base 2 and to prevent the portable cooler 1 from accidentally tipping over when in use. The base 2 can be shaped in a variety of forms such as football shoes, track shoes or the like to add to the visual appearance of the portable cooler 1.

Figure 9:
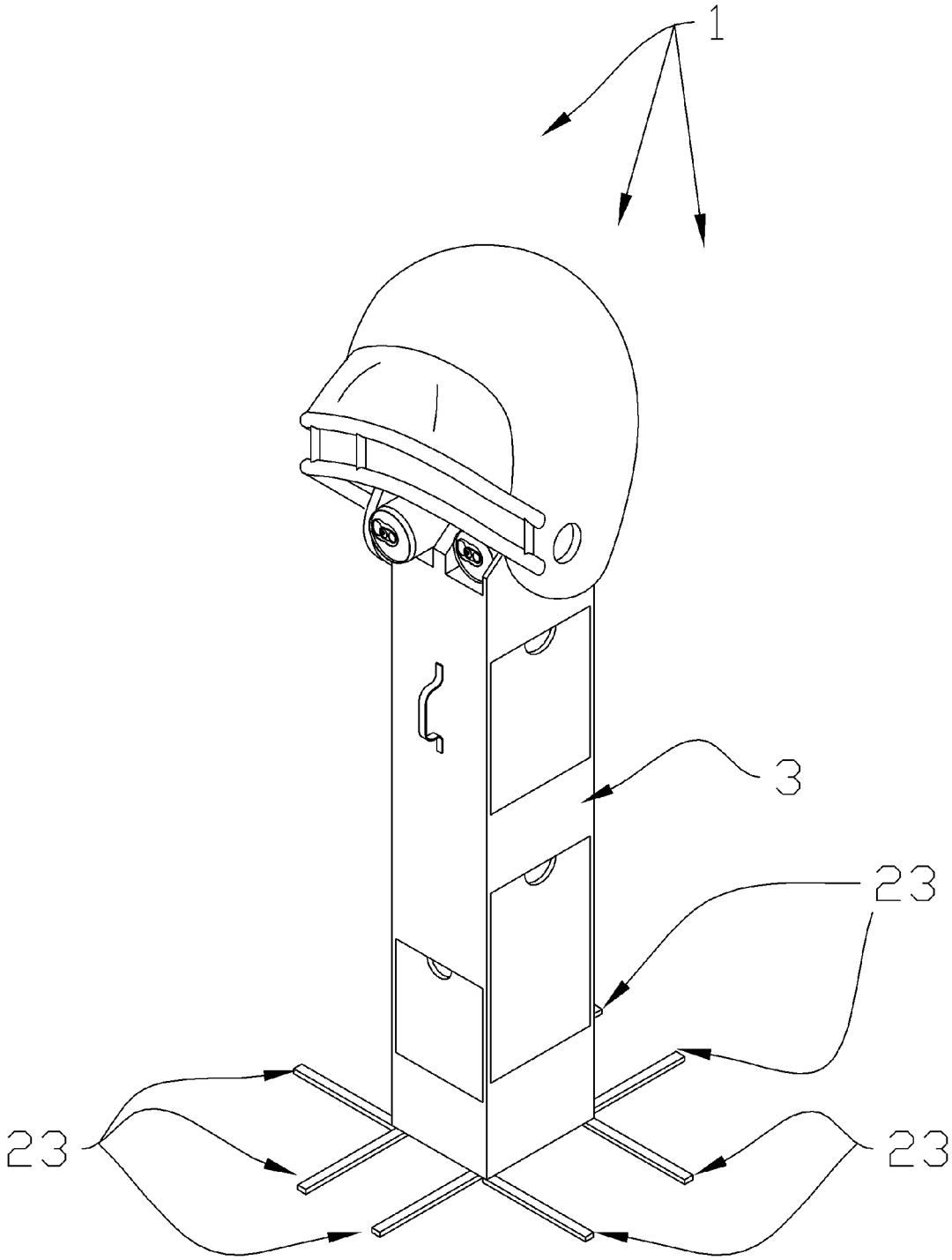
FIG. 9 is an alternate base support perspective view.
Figure 10:
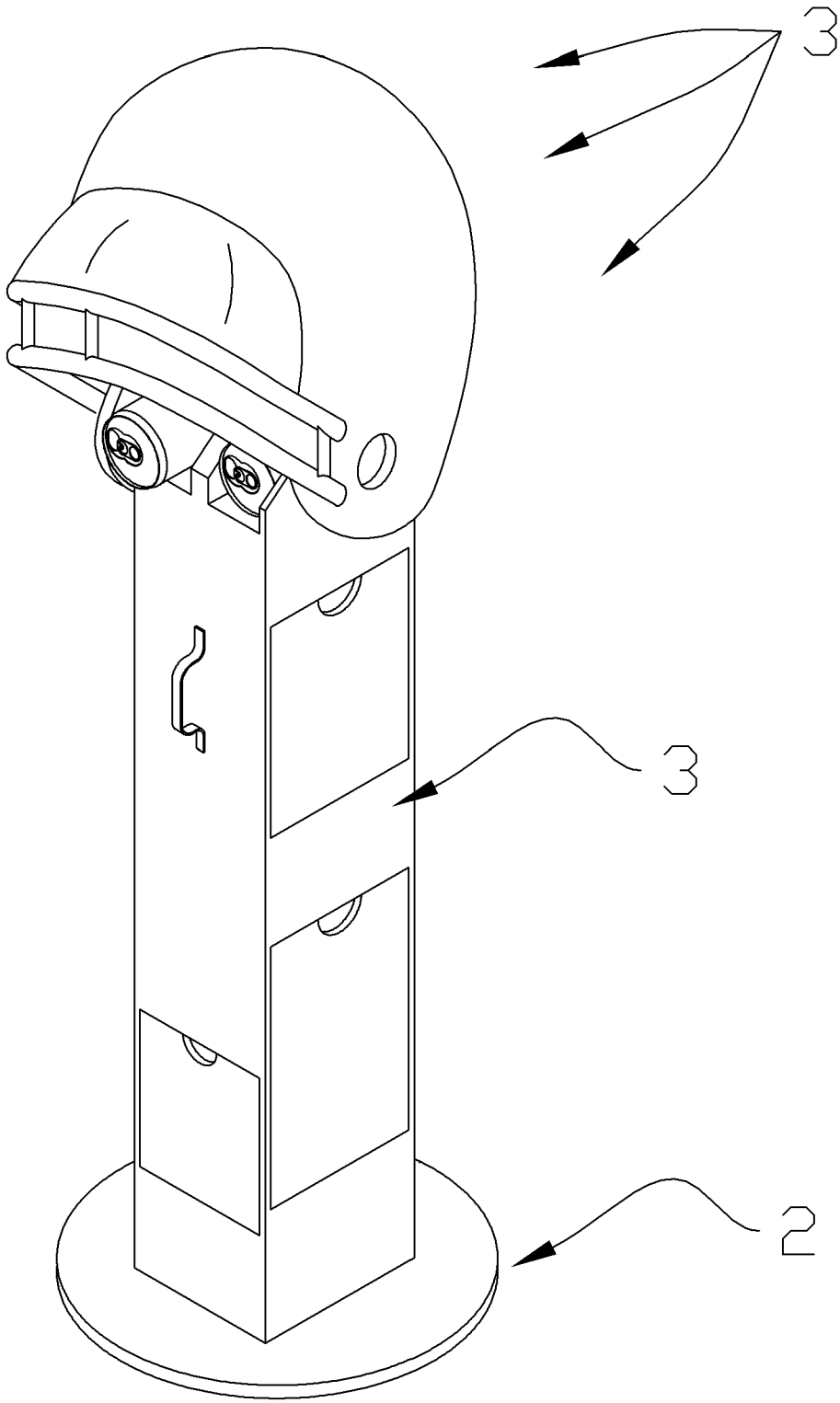
FIG. 10 is another alternate base support perspective view.

FIGS. 9 and 10 depict alternative embodiments to the base 2. FIG. 9 depicts the base 2 as being multiple support bars 23 that fold out when in use or fold in during transportation or storage so as to conserve space. The support bars 23 could either pivot under the base of the cooler body 3 when not in use or the support bars 23 could fold up along the sides of the cooler body 3 when not in use. When the support bars 23 are of the type that fold up along the sides of the cooler body 3 when not in use, there would be a means to secure the support bars 23 to the sides of the cooler body 3 when in storage or during transportation and a means to secure the support bars 23 perpendicular to the sides of the cooler body 3 when in use.

FIG. 10 depicts the base 2 as a flat round structure of sufficient weight to prevent the portable cooler 1 from accidentally tipping over when in use. The base 2 in any embodiment could either be fixed to the cooler body 3 or be a removable piece that the cooler body 3 sets into.

Figure 11:
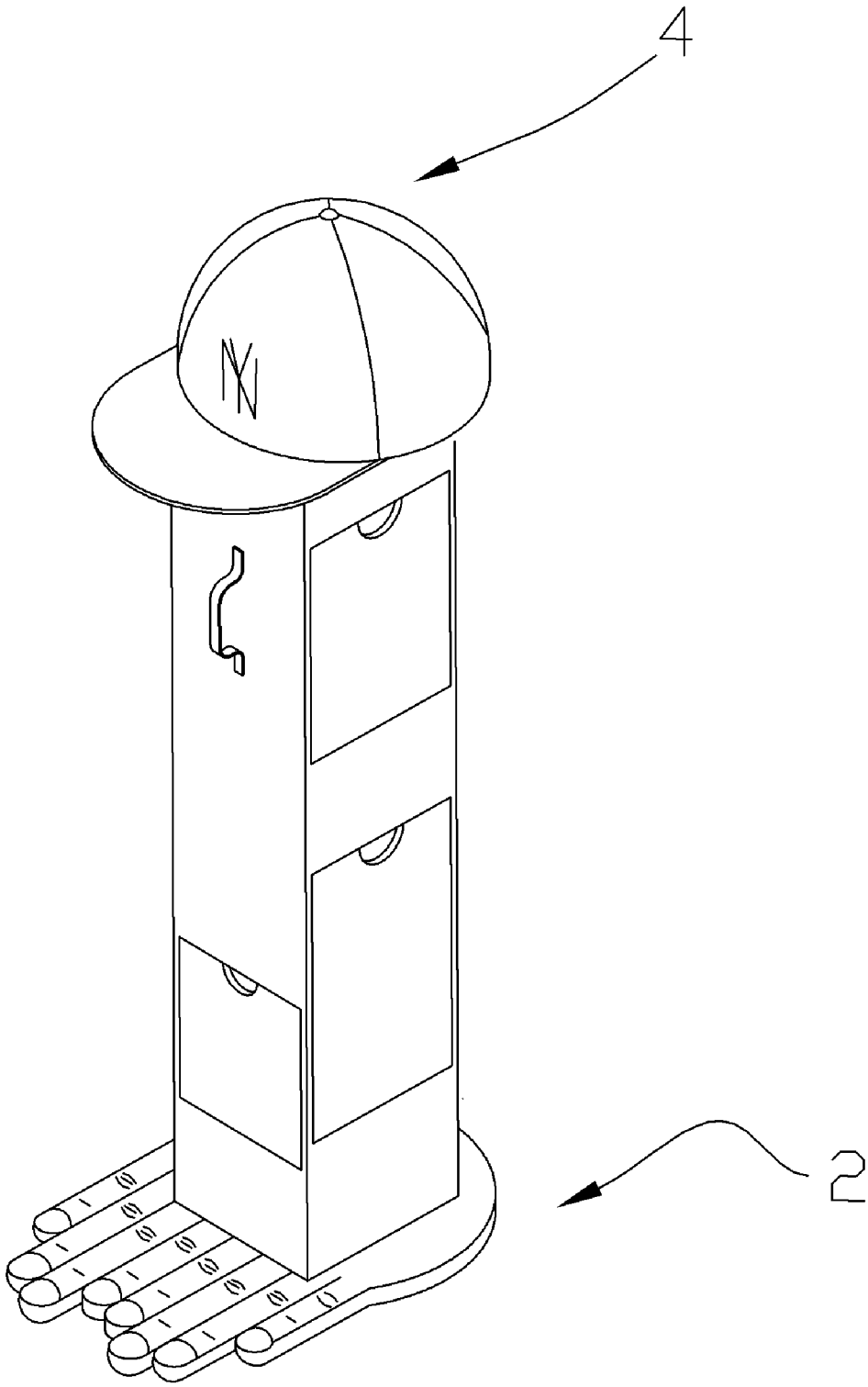
FIG. 11 is a perspective view of the present invention showing the base as a set of hands and the lid as a baseball cap.

FIG. 11 depicts the base 2 as a set of hands of sufficient width and length to prevent the portable cooler 1 from accidentally tipping over when in use. The base 2 could either be fixed to the cooler body 3 or be a removable piece that the body cooler sets into. The lid 4 is depicted as a baseball cap.

Figure 12:
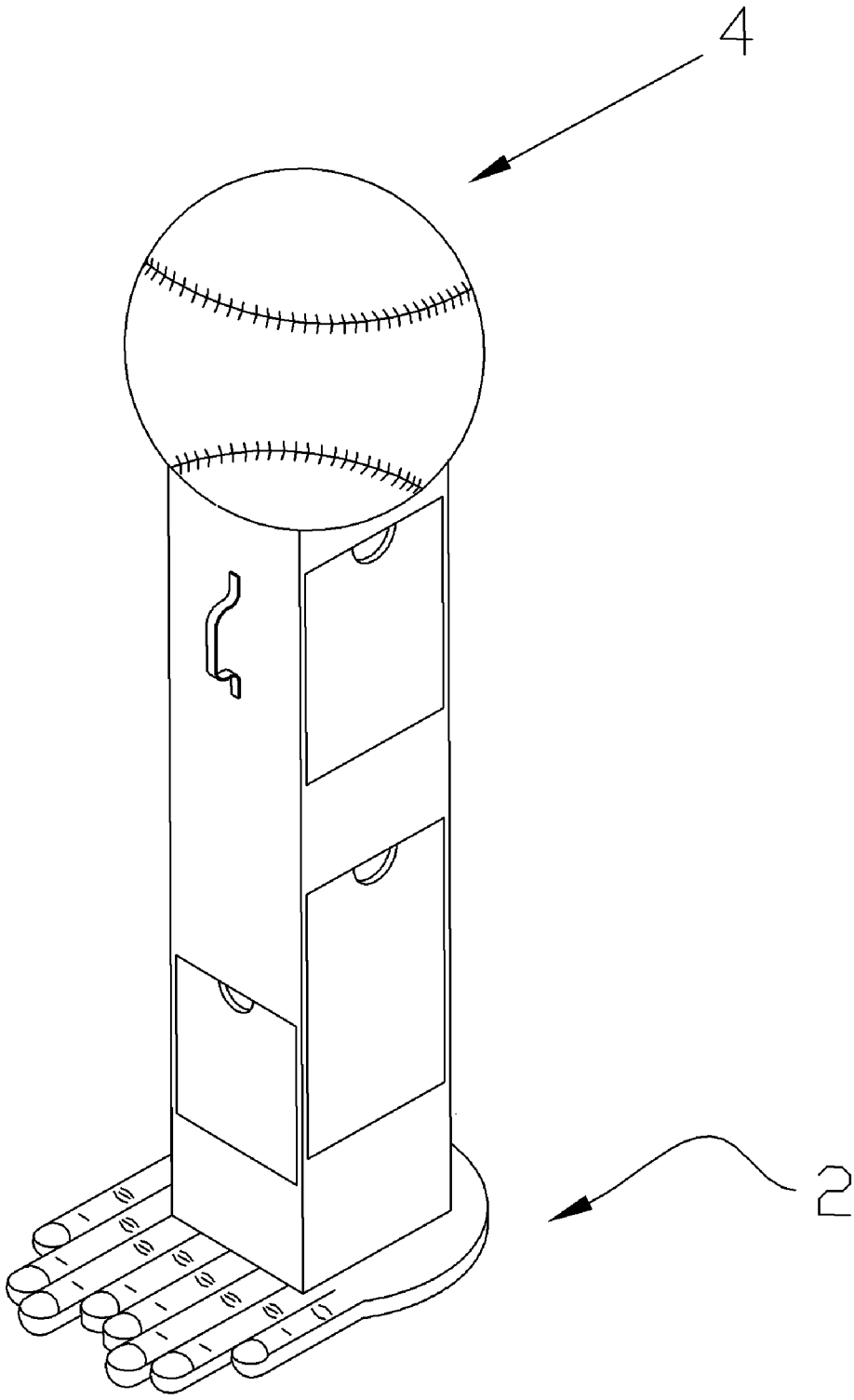
FIG. 12 is a perspective view of the present invention showing the base as a set of hands and the lid as a baseball.

FIG. 12 depicts the base 2 as a set of hands of sufficient width and length to prevent the portable cooler 1 from accidentally tipping over when in use. The base 2 could either be fixed to the cooler body 3 or be a removable piece that the body cooler sets into. The lid 4 is depicted as a baseball.

Figure 13:
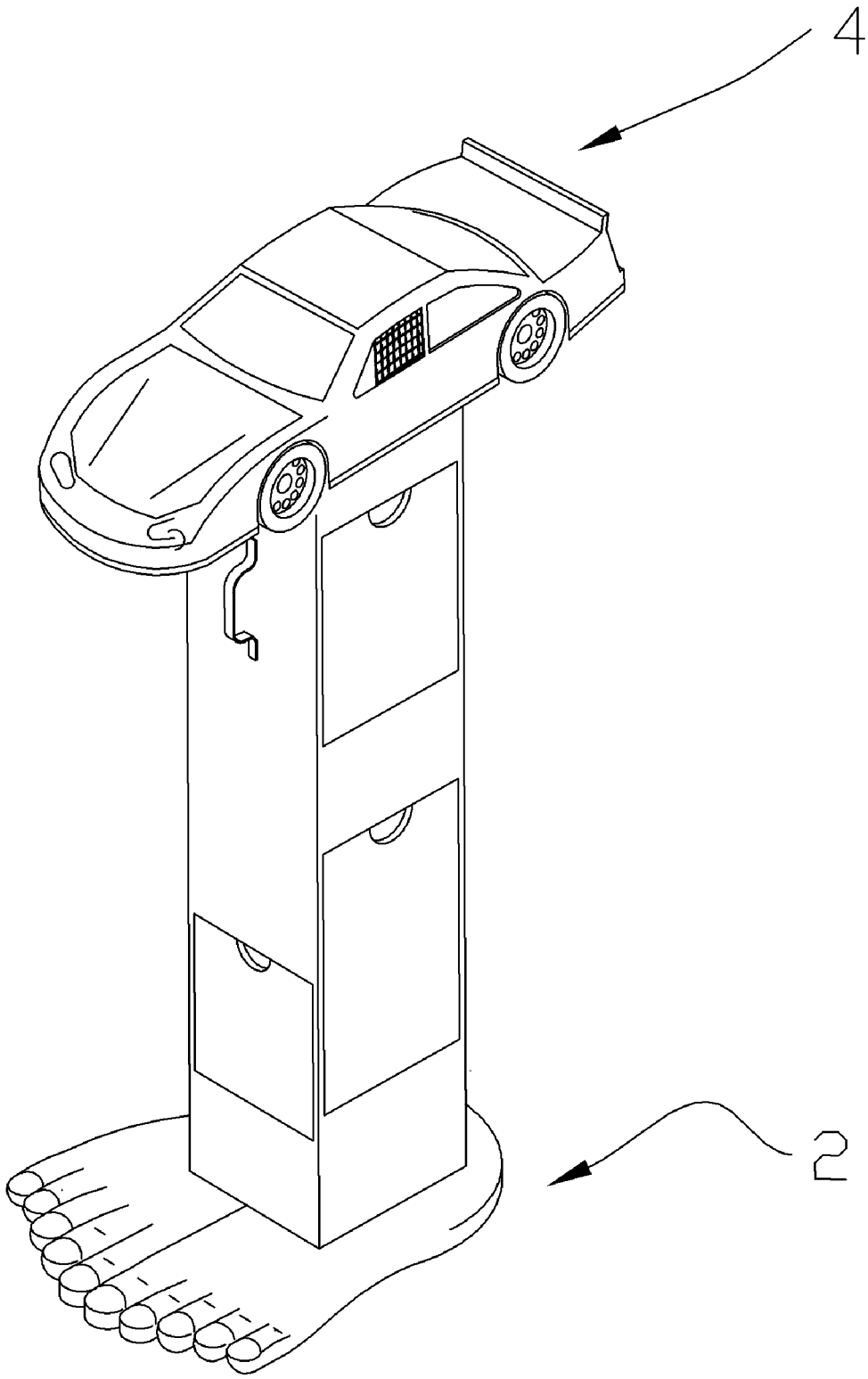
FIG. 13 is a perspective view of the present invention showing the base as a set of feet and the lid as a race car.

FIG. 13 depicts the base 2 as a set of feet of sufficient width and length to prevent the portable cooler 1 from accidentally tipping over when in use. The base 2 could either be fixed to the cooler body 3 or be a removable piece that the body cooler sets into. The lid 4 is depicted as a racecar.

Any of the above descriptions of the base 2 and lid 4 could be utilized with the portable cooler 1 to create a stable portable cooler without detracting or diminishing from the invention.

I claim:

1. A portable cooler device for drinks comprising a front wall, two side walls, a back wall, a bottom, a hinged lid with means to secure said lid to said front wall and a carrying handle located in the top half of said front wall, each of said side walls having a hinged drop down tray and a hinged drop down drink holder, said trays and said drink holders having a means to be temporarily secured in a closed position in said side walls during storage or transportation and a means for temporarily folding out, parallel to the ground surface, to store said drinks and food stuffs during use of said portable cooler, the inside of said portable cooler having a fixed separator in the lower half of said cooler, said separator having at least one compression spring mounted to the top of said separator and at least one movable tray mounted to the top of said compression spring, said movable tray being forced downward when drinks are placed inside of said cooler, and said compression spring forcing said movable tray and said drinks to the top of said cooler for easy removal, said drinks being stacked one on top of another in at least one column with space adjacent to said column for frozen refrigerator packs to keep said drinks cold, the lower half of said front wall having a hinged drawer for storing items with a means for temporarily securing said drawer during transportation or storage and a means to un-secure and open said drawer when in use.

2. A portable cooler device for drinks comprising a front wall, two side walls, a back wall, a bottom, a hinged lid with means to secure said lid to said front wall and a carrying handle located in the top half of said front wall, each of said side walls having a hinged drop down tray and a hinged drop down drink holder, said trays and said drink holders having a means to be temporarily secured in a closed position in said side walls during storage or transportation and a means for temporarily folding out, parallel to the ground surface, to store said drinks and food stuffs during use of said portable cooler, the inside of said portable cooler having a fixed separator in the lower half of said cooler, said front wall having at least one door located above said separator for opening to remove said drink when said drinks are placed inside of said cooler, said drinks being gravity fed to said separator and said front door for easy removal, said drinks being stacked one on top of another in at least one column with space adjacent to said column for frozen refrigerator packs to keep said drinks cold, the lower half of said front wall having a hinged drawer for storing items with a means for temporarily securing said drawer during transportation or storage and a means to un-secure and open said drawer when in use.

3. A portable cooler device for drinks comprising a front wall, two side walls, a back wall, a bottom, a hinged lid with means to secure said lid to said front wall and a carrying handle located in the top half of said front wall, each of said side walls having a hinged drop down tray and a hinged drop down drink holder, said trays and said drink holders having a means to be temporarily secured in a closed position in said side walls during storage or transportation and a means for temporarily folding out, parallel to the ground surface, to store said drinks and food stuffs during use of said portable cooler, the inside of said portable cooler having a fixed separator in the lower half of said cooler, said separator having at least one compression spring mounted to the top of said separator and at least one movable tray mounted to the top of said compression spring, said movable tray being forced downward when drinks are placed inside of said cooler, and said compression spring forcing said movable tray and said drinks to the top of said cooler for easy removal, said drinks being stacked one on top of another in at least one column with space adjacent to said column for frozen refrigerator packs to keep said drinks cold, the lower half of said front wall having a hinged drawer for storing items with a means for temporarily securing said drawer during transportation or storage and a means to un-secure and open said drawer when in use, wherein said portable cooler walls, bottom and lid are insulated in order to keep the contents of said portable cooler chilled.

4. A portable cooler device for drinks comprising a front wall, two side walls, a back wall, a bottom, a hinged lid with means to secure said lid to said front wall and a carrying handle located in the top half of said front wall, each of said side walls having a hinged drop down tray and a hinged drop down drink holder, said trays and said drink holders having a means to be temporarily secured in a closed position in said side walls during storage or transportation and a means for temporarily folding out, parallel to the ground surface, to store said drinks and food stuffs during use of said portable cooler, the inside of said portable cooler having a fixed separator in the lower half of said cooler, said front wall having at least one door located above said separator for opening to remove said drink when said drinks are placed inside of said cooler, said drinks being gravity fed to said separator and said front door for easy removal, said drinks being stacked one on top of another in at least one column with space adjacent to said column for frozen refrigerator packs to keep said drinks cold, the lower half of said front wall having a hinged drawer for storing items with a means for temporarily securing said drawer during transportation or storage and a means to un-secure and open said drawer when in use, wherein said portable cooler walls, bottom and lid are insulated in order to keep the contents of said portable cooler chilled.

5. The invention according to any one of claims 1, 2, 3 or 4, wherein said bottom of said portable cooler sits fixedly on a base that is wider and longer than said bottom to provide stability to said portable cooler wherein said base is in the shape of shoes.

6. The invention according to any one of claims 1, 2, 3 or 4, wherein said bottom of said portable cooler sits fixedly on of a base that is wider and longer than said bottom to provide stability to said portable cooler wherein said base is in the shape of hands.

7. The invention according to any one of claims 1, 2, 3 or 4, wherein said bottom of said portable cooler sits removably inside of a base that is wider and longer than said bottom to provide stability to said portable cooler and wherein said lid is in the shape of a football helmet.

8. The invention according to any one of claims 1, 2, 3 or 4, wherein said bottom of said portable cooler sits fixedly on of a base that is wider and longer than said bottom to provide stability to said portable cooler and wherein said lid is in the shape of a football helmet.

9. The invention according to any one of claims 1, 2, 3 or 4, wherein said bottom of said portable cooler sits removably inside of a base that is wider and longer than said bottom to provide stability to said portable cooler and wherein said lid is in the shape of a baseball hat.

10. The invention according to any one of claims 1, 2, 3 or 4, wherein said bottom of said portable cooler sits fixedly on of a base that is wider and longer than said bottom to provide stability to said portable cooler and wherein said lid is in the shape of a baseball hat.

11. The invention according to any one of claims 1, 2, 3 or 4, wherein said bottom of said portable cooler sits removably inside of a base that is wider and longer than said bottom to provide stability to said portable cooler and wherein said lid is in the shape of a football.

12. The invention according to any one of claims 1, 2, 3 or 4, wherein said bottom of said portable cooler sits fixedly on of a base that is wider and longer than said bottom to provide stability to said portable cooler and wherein said lid is in the shape of a football.

13. The invention according to any one of claims 1, 2, 3 or 4, wherein said bottom of said portable cooler sits removably inside of a base that is wider and longer than said bottom to provide stability to said portable cooler and wherein said lid is in the shape of a soccer ball.

14. The invention according to any one of claims 1, 2, 3 or 4, wherein said bottom of said portable cooler sits fixedly on of a base that is wider and longer than said bottom to provide stability to said portable cooler and wherein said lid is in the shape of a soccer ball.

15. The invention according to any one of claims 1, 2, 3 or 4, wherein said bottom of said portable cooler sits removably inside of a base that is wider and longer than said bottom to provide stability to said portable cooler and wherein said lid is in the shape of a basketball.

16. The invention according to any one of claims 1, 2, 3 or 4, wherein said bottom of said portable cooler sits fixedly on of a base that is wider and longer than said bottom to provide stability to said portable cooler and wherein said lid is in the shape of a basketball.

17. The invention according to any one of claims 1, 2, 3 or 4, wherein said bottom of said portable cooler sits removably inside of a base that is wider and longer than said bottom to provide stability to said portable cooler and wherein said lid is in the shape of a baseball.

18. The invention according to any one of claims 1, 2, 3 or 4, wherein said bottom of said portable cooler sits fixedly on of a base that is wider and longer than said bottom to provide stability to said portable cooler and wherein said lid is in the shape of a baseball.

19. The invention according to any one of claims 1, 2, 3 or 4, wherein said bottom of said portable cooler sits removably inside of a base that is wider and longer than said bottom to provide stability to said portable cooler and wherein said lid is in the shape of a racecar.

20. The invention according to any one of claims 1, 2, 3 or 4, wherein said bottom of said portable cooler sits fixedly on of a base that is wider and longer than said bottom to provide stability to said portable cooler and wherein said lid is in the shape of a racecar.

21. The invention according to any one of claims 1, 2, 3 or 4, wherein said bottom of said portable cooler sits removably inside of a base that is wider and longer than said bottom to provide stability to said portable cooler.

22. The invention according to any one of claims 1, 2, 3 or 4, wherein said bottom of said portable cooler sits fixedly on of a base that is wider and longer than said bottom to provide stability to said portable cooler.

23. The invention according to any one of claims 1, 2, 3, or 4, wherein said bottom of said portable cooler sits removably inside of a base that is wider and longer than said bottom to provide stability to said portable cooler wherein said base is in the shape of shoes.

24. The invention according to any one of claims 1, 2, 3, or 4, wherein said bottom of said portable cooler sits removably inside of a base that is wider and longer than said bottom to provide stability to said portable cooler and wherein said base is in the shape of hands.

25. The invention according to any one of claims 1, 2, 3 or 4, wherein there are a plurality of pivotal support bars mounted to said bottom of said portable cooler that can be pivoted out from underneath said bottom to provide a stable support base for said portable cooler when in use and said support bars being pivoted back underneath said bottom and temporarily secured when said portable cooler is in storage or during transportation.

26. The invention according to any one of claims 1, 2, 3 or 4, wherein the there are a plurality of pivotal support bars mounted to the base of said front, sides and back walls of said portable cooler that can be pivoted down from said walls and temporarily held in place to provide a stable support base for said portable cooler when in use and said support bars being pivoted back up to said walls and temporarily secured in place when said portable cooler is in storage or during transportation.

27. The invention according to any one of claims 1, 2, 3 or 4, wherein said lid is in the shape of a football helmet.

28. The invention according to any one of claims 1, 2, 3 or 4, wherein said lid is in the shape of a baseball hat.

29. The invention according to any one of claims 1, 2, 3 or 4, wherein said lid is in the shape of a football.

30. The invention according to any one of claims 1, 2, 3 or 4, wherein said lid is in the shape of a soccer ball.

31. The invention according to any one of claims 1, 2, 3 or 4, wherein said lid is in the shape of a basketball.

32. The invention according to any one of claims 1, 2, 3 or 4, wherein said lid is in the shape of a baseball.

33. The invention according to any one of claims 1, 2, 3 or 4, wherein said lid is in the shape of a racecar.

34. The invention according to any one of claims 1, 2, 3 or 4, wherein there is a shoulder carrying strap attached to said portable cooler.

* * * * *